US005572761A

United States Patent [19]

Meyer

[11] Patent Number: 5,572,761

[45] Date of Patent: Nov. 12, 1996

[54] PORTABLE GOLF BALL AND CLUB CLEANER CUP

[76] Inventor: Roy Meyer, 7222 Charlie Hall St., Fort Meade, Md. 20755

[21] Appl. No.: 392,254

[22] Filed: Feb. 22, 1995

[51] Int. Cl.[6] ..... A63B 47/04

[52] U.S. Cl. ..... 15/21.2; 15/104.92; 15/160

[58] Field of Search ..... 15/21.2, 160, 104.92, 15/104.94; 273/32 R

[56] References Cited

U.S. PATENT DOCUMENTS

| | | | |
|---|---|---|---|
| 1,781,113 | 11/1930 | Laing | 15/21.2 |
| 3,101,497 | 8/1963 | Derkocz | 15/21.2 |
| 3,271,802 | 9/1966 | Thompson | 15/21.2 |
| 3,583,016 | 6/1971 | McConnell | 15/21.2 |
| 4,344,203 | 8/1982 | Gerrick | 15/21.2 |
| 4,945,596 | 8/1990 | Chang et al. | 15/21.2 |
| 4,965,906 | 10/1990 | Mauro | 15/21.2 |

*Primary Examiner*—David Scherbel

*Assistant Examiner*—Randall E. Chin

*Attorney, Agent, or Firm*—Walter G. Finch; Nancy A. Smith

[57] ABSTRACT

A golf ball and golf club head cleaner including a leak resistant container which has a lid and open cylindrical portion for receiving a cleaning fluid therein. The lid has a ball holder attached at the end of an extender portion and a handle attached on top forming one rigid piece. A rigid bristle cage formed of plastic or wire mesh internally lined with bristles is placed inside of the open cylinder. A golf ball is placed into an opening in the center of the ball holder and secured by a pair of alternate prongs. The ball holder is then immersed into the container and swished about against the bristles in the liquid detergent. To clean a golf club head the ball holder is removed and the club head is immersed in the detergent liquid in the container. One side of the ball holder has bristles for easy cleaning of the deep grooves on the golf club head. A clip is attached to the side of the container for attachment to a golf bag for easy transportation. There is a removable elastic fastener for attaching the lip to the container.

18 Claims, 2 Drawing Sheets

PORTABLE GOLF BALL AND CLUB CLEANER CUP

BACKGROUND OF THE INVENTION

This invention relates to the field of devices for cleaning golf balls, and in particular to devices which are leak resistant and can be attached directly to the golf bag and easily removed for refilling or use.

Examples of other portable golf ball cleaning devices include those shown in the following United States patents.

U.S. Pat. No. 5,155,883 teaches a golf ball and club cleaner which is a container having counter rotating brush members. The brush members rotate in response to a golf club head being moved between them. The brushes also rotate in response to an external control for ball cleaning. This device does not provide for connection to a golf bag.

U.S. Pat. No. 3,806,983 discloses a lined pouch which can be manipulated by hand to clean a golf ball. This device is not leak resistant, nor can it be used to clean a golf club head.

U.S. Pat. No. 4,899,413 discloses a portable golf ball cleaning device in the shape of a cup. The cup has a ring of brushes fixed to the bottom and a screw cap. The cap has spring fingers to hold the ball and a rotatable upper brush. This device does not provide for the cleaning of a golf club head.

However, none of the prior art golf ball cleaners provides for a portable ball and club cleaning device which can attach to the side of golf bag. Several of these devices have moving parts which can break. The present invention has no moving parts.

The device of the present invention also provides for a leak resistant cap to prevent loss of cleaning fluid during transportation. Furthermore, the present invention has a removable bristle cage for easy cleaning or replacement. In addition, there are bristles positioned along a ball holder for deep groove cleaning of a golf club head. Finally, there is an external clip for attaching the cup to a golf bag.

SUMMARY OF THE INVENTION

Therefore, it is an object of this invention to provide for a golf ball and club cleaning device that has a leak resistant container for housing a detergent solution with a removable cap.

It is another object of this invention to provide for a golf ball and club cleaning device which includes an extended pronged ball holder attached to the removable cap.

It is yet another object of this invention to provide for a removable bristle cage to be positioned inside of the leak resistant container for abrasively cleaning a golf ball or golf club head.

It is still another object of this invention to provide for a ball holder with side bristles for cleaning the grooves of a golf club head.

DETAILED DESCRIPTION OF THE DRAWINGS

Figure 1:
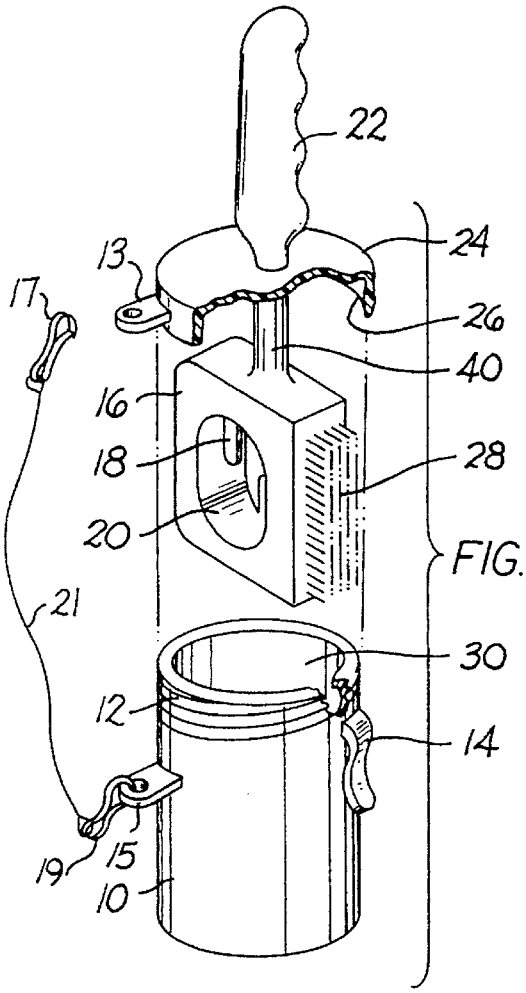
FIG. 1 shows a perspective view of one embodiment of the invention.

One embodiment of the device of the present invention as shown in FIG. 1 includes a container 10 with a threaded top 12 for holding a liquid detergent (not shown). A lid 24 with a threaded interior edge 26 fits onto the threaded top 12 of the container 10. The mating threaded portions 12 and 26 provide a leak resistant seal for the container. The interior 30 of the container 10 is wide enough and deep enough to receive a sufficient amount of cleaning fluid therein. The lid 24 has a gripper handle 22 positioned on the top for easy opening and closing.

Figure 4:
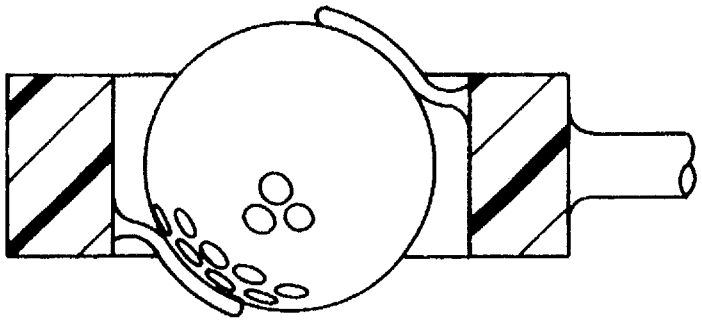
FIG. 4 shows a cross-sectional view of the ball holder of FIGS. 1 and 2.

Attached to the inside of the lid is a ball holder 16 which is positioned at the end of an extender portion 40. The extender portion 40 allows the ball to be cleaned to be inserted deeply into the container 10. The ball holder 16 has an opening 20 for receiving a golf ball therein. Prongs 18 positioned on alternate sides and ends of the opening 20 in the ball holder 16 hold a golf ball in place for cleaning. As shown in FIG. 4, the two prongs 18 extend nearly midway into the center of opening 20 allowing a golf ball to be held therebetween. The prongs are resilient and provide for easy insertion and removal of a golf ball.

Figure 3:
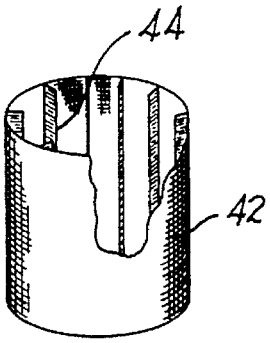
FIG. 3 shows a cut away view of a mesh bristle cage.

FIG. 3 shows a mesh cage 42 lined on its interior with rows of bristles 44. The mesh cage 42 fits inside of the container 10. There is a lip 11 made of a flexible material to retain the mesh cage 42 inside of the container 10. The lip 11 allows easy insertion and removal of the cage 42.

The mesh cage 42 can be formed of wire or plastic. The bristles 44 extend off the mesh toward the center of the container 10. A golf ball is inserted into the opening 20 in the ball holder 16. The ball holder 16 is submerged in the detergent (not shown) held in the container 10. By twisting the gripper handle 22 on the container top 24, the golf ball is agitated in the detergent and scrubbed against the bristles 44. This action cleans the golf ball.

Alternatively, the lid 24 and ball holder 16 can be removed and a golf club head can be inserted into the container 10 for cleaning. Along one side of the ball holder 16 is a plurality of bristles 28 for deep cleaning the grooves on a golf club head.

Figure 2:
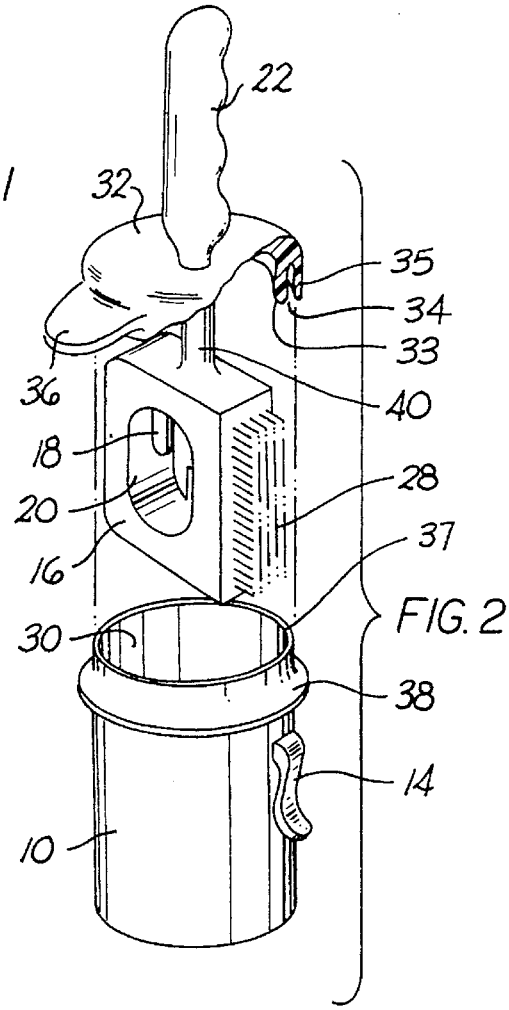
FIG. 2 shows a perspective view of a second embodiment of the invention.

A second embodiment of the invention is shown in FIG. 2, wherein the lid 32 has a double-lipped edge having an inner lip 33 and an outer lip 35 with a groove 34 formed therebetween. The lid 32 fits onto the rim 37 of the container 10. Below the rim 37 is an extended edge 38. The inner lip 33 of the lid 32 fits inside of the rim 37 of the container 10. The outer lip 35 of the lid 32 fits outside of the rim 37 such that the rim 37 fits into the groove 34.

The lid rests on the extended edge 38. This forms a leak resistant seal between the lid 32 and the container 10. The lid 32 is removed from the container 10 by lifting the tab 36 positioned on one side of the lid 32.

The ball holder 16 and the bristle cage 42 remain the same in the second embodiment. There is a flexible inner lip 11 for retaining the bristle cage 42. A ball is inserted into the ball holder opening 20 and secured by the prongs 18. While holding the lid handle 22, the ball holder is immersed into the liquid detergent. The handle is then twisted so as to move the ball against the bristles for cleaning.

In both embodiments there is a clip 14 attached to the side of the container 10 for easy attachment and detachment from the golf bag. There is also a pair of tabs 13 and 15. One tab 13 is attached to the lid 24 of the device. The other tab 15 is attached to the container 10. Each tab has an aperture for receiving a fastener therein. There are two fasteners 17 and 19 which are connected by an elastic cord 21. The fasteners 17 and 19 are hooked onto the tabs 13 and 15. The elastic cord 21 acts as a connection between the lid 24 and the container 10. This prevents the lid 24 from being dropped or lost. This fastener can also be used with the second embodiment of the invention (not shown) in the same way.

It is understood that the present invention is not limited to the previous descriptions and drawings which merely illustrate the preferred embodiment thereof. Minor changes in form can be made to the device with departing from the intended scope of the invention.

What is claimed is:

1. A golf ball and club cleaner, comprising:

a means having a lid portion and an open curved portion for receiving a liquid therein;

a ball holder means comprising a rectangular member having an opening therethrough and having an extender portion which is fixedly attached to the inside of said lid portion;

a removable bristle means for insertion into said open curved portion for scrubbing an object, wherein said removable bristle means comprises a mesh cage means having rows of bristles attached along its inner sides wherein said rows of bristles extend into the center of said open curved portion;

a clip means attached to said container for attachment to a golf bag; and a handle fixedly attached to the top of the outside of said lid portion of said container means for manipulating said ball holder means against said removable bristle means within said open curved portion.

2. A golf ball and club cleaner as recited in claim 1, wherein said first recited means is a leak resistant container.

3. A golf ball and club cleaner as recited in claim 2 wherein said lid portion of said leak resistant container is a screw cap and the top edge of said open curved portion is threaded for mating with said screw cap.

4. A golf ball and club cleaner as recited in claim 2 wherein said lid portion of said leak resistant container has an edge having an inner lip and an outer lip with a groove formed therebetween for receiving the top edge of said open curved portion therein.

5. A golf ball and club cleaner as recited in claim 1, wherein said rectangular member having an opening therethrough receives a golf ball therein and has prongs extending along said opening for securing said golf ball within said opening.

6. A golf ball and club cleaner as recited in claim 1, wherein said ball holder means comprises a plurality of bristles attached to one side of the said rectangular member.

7. A golf ball and club cleaner as recited in claim 1, wherein said mesh cage means is cylindrical and formed of wire mesh.

8. A golf ball and club cleaner as recited in claim 1, wherein said mesh cage means is cylindrical and formed of plastic mesh.

9. A golf ball and club cleaner as recited in claim 1, further comprising a fastener means attached to both said lid portion and said open curved portion and a flexible inner lip attached to the top inner edge of said open curved portion for retaining said removable bristle means therein.

10. A golf ball and club cleaner as recited in claim 9, wherein said fastener means is elastic.

11. A portable golf ball and club cleaner, comprising:

an open container;

a lid for fitting into said open container;

a ball holder means comprising a rectangular member having an opening therethrough and having an extender portion and being rigidly attached to said lid;

a removable bristle cage for insertion into said open container for scrubbing a golf ball placed therein wherein said removable bristle cage comprises a mesh cage having rows of bristles attached along its inner sides wherein said rows of bristles extend into the center of said open container;

a clip attached to the outside of said open container for attaching said open container to a golf bag.

12. A portable golf ball and club cleaner as recited in claim 11, wherein said open container and said lid form a leak resistant seal.

13. A portable golf ball and club cleaner as recited in claim 12, wherein said lid is a screw cap.

14. A portable golf ball and club cleaner as recited in claim 12 wherein said lid has an edge having an inner lip and an outer lip with a groove formed therebetween for receiving the top edge of said open container therein.

15. A portable golf ball and club cleaner as recited in claim 11, wherein said ball holder is further comprised of, prongs extending along said opening for securing said golf ball within said opening.

16. A portable golf ball and club cleaner as recited in claim 11 wherein said removable bristle cage is cylindrical and formed of wire mesh.

17. A portable golf ball and club cleaner as recited in claim 11 wherein said removable bristle cage is cylindrical and formed of plastic mesh.

18. A portable golf ball and club cleaner as recited in claim 11, further comprising a flexible inner lip attached to the top inner edge of said open container for retaining said removable bristle cage therein.

* * * * *